US007893670B2

(12) United States Patent
Pulijala et al.

(10) Patent No.: US 7,893,670 B2
(45) Date of Patent: Feb. 22, 2011

(54) FREQUENCY COMPENSATION SCHEME FOR STABILIZING THE LDO USING EXTERNAL NPN IN HV DOMAIN

(75) Inventors: Srinivas K. Pulijala, Tucson, AZ (US); Scott C. McLeod, Oro Valley, AZ (US)

(73) Assignee: Standard Microsystems Corporation, Hauppauge, NY (US)

( * ) Notice: Subject to any disclaimer, the term of this patent is extended or adjusted under 35 U.S.C. 154(b) by 181 days.

(21) Appl. No.: 12/389,581

(22) Filed: Feb. 20, 2009

(65) Prior Publication Data

US 2010/0213917 A1 Aug. 26, 2010

(51) Int. Cl.
*G05F 1/00* (2006.01)

(52) U.S. Cl. ..... 323/273; 323/280; 323/314; 323/315

(58) Field of Classification Search ..... 323/273, 323/280, 281, 293, 311, 312, 313, 314, 315
See application file for complete search history.

(56) References Cited

U.S. PATENT DOCUMENTS 5,726,563 A * 3/1998 Bolton, Jr. ..... 323/315
7,612,548 B2 * 11/2009 Jian ..... 323/280
2002/0093325 A1 * 7/2002 Ju ..... 323/316
2007/0216382 A1 * 9/2007 Lin et al. ..... 323/273

* cited by examiner

*Primary Examiner*—Bao Q Vu
*Assistant Examiner*—Nguyen Tran
(74) *Attorney, Agent, or Firm*—Meyertons Hood Kivlin Kowert & Goetzel, P.C.; Jeffrey C. Hood

(57) ABSTRACT

A voltage regulator may comprise a regulator output configured to provide a regulated voltage, which may be controlled by an error amplifier based on the regulated voltage and a reference voltage. The error amplifier may control a source-follower stage to mirror a multiple of the current flowing in the source-follower stage into an internal pass device. A voltage developed by the mirror current may control an external pass device configured to deliver the load current into the regulator output. A first resistor may be configured to decouple a load capacitor coupled between the regulator output and reference ground, when the load current is below a specified value. A second resistor may be configured to create a bias current in the internal pass device even when the external pass device is close to cut-off region. A third resistor may be configured to counter the effects of negative impedance at the control terminal of the external pass device caused by the current-gain of the external pass device. A compensation capacitor and resistor may be coupled in series between the output of the error amplifier and the output of the voltage regulator to provide frequency compensation for the Miller-Effect.

29 Claims, 6 Drawing Sheets

FREQUENCY COMPENSATION SCHEME FOR STABILIZING THE LDO USING EXTERNAL NPN IN HV DOMAIN

BACKGROUND OF THE INVENTION

1. Field of the Invention

This invention relates generally to the field of semiconductor circuit design, and more particularly to the design of improved power regulators.

2. Description of the Related Art

Many electronic power supplies feature voltage regulators, or regulator circuits, designed to automatically maintain a constant output voltage level to effectively provide a steady voltage to the electronic circuit to which power is being supplied, typically referred to as the load. More particularly, the object of a voltage regulator circuit is to maintain a steady output voltage regardless of current drawn by the load. Most present day voltage regulators operate by comparing the actual output voltage to a fixed—typically internal—reference voltage. The difference between the actual output voltage and reference voltage is amplified, and used for controlling a regulation element, to form a negative feedback servo control loop. The regulation element is typically configured to produce a higher voltage when the output voltage is too low, and in case of some regulators, to produce a lower voltage when the output voltage is too high. In many cases, the regulation element may be configured to simply stop sourcing current, and depend on the current drawn by the driven load to pull down the regulator output voltage. The control loop has to be carefully designed to produce the desired tradeoff between stability and speed of response.

The operation of power supplies is typically affected by variations on the input voltage (or power supply) line that provides the voltage based on which the regulated output voltage is generated. Any signal or noise (including transients, which may reach very high levels relative to the level of the desired output voltage) on the supply line may couple into, and may be amplified by the active circuitry, thereby degrading the performance of the power supply. Therefore, in addition to design considerations related to stability and speed of response, power supplies are also typically designed to achieve a desired power supply rejection ratio (PSRR), which is indicative of the amount of noise (on the supply line) that the power regulator is capable of rejecting. Various systems may specify different power supply rejection requirements.

Another important measure of the effectiveness of a voltage regulator circuit is its ability to quickly stabilize when responding to a demand for high current. For example, when the demand for current to be supplied by the voltage regulator suddenly changes, an ideal voltage regulator should be able to meet the demand for increased current while maintaining its desired output voltage $V_{out}$. However, this may not always be practical for a given voltage regulator circuit and a given load. For example, in many cases an external pass-device, typically a pass-transistor is used to ensure sufficient load current for high-voltage applications. As the load current quickly rises from no current to maximum load current, the voltage regulator may become unstable. Many present day implementations use a large internal pass transistor, and/or large current load at the output of the regulator to help stabilize the voltage regulator. However, system requirements oftentimes prevent the use of these devices, and other solutions might be preferable, or even required.

Many other problems and disadvantages of the prior art will become apparent to one skilled in the art after comparing such prior art with the present invention as described herein.

SUMMARY OF THE INVENTION

In one set of embodiments, a voltage regulator may comprise a regulator output configured to provide a regulated voltage, built around an error amplifier powered by a supply voltage and having a first input configured to receive a reference signal. A source-follower stage may be controlled by the output of the error amplifier to mirror a multiple of the current flowing in the source-follower stage into an internal pass device. A voltage developed by the mirror current (which is a multiple of the current flowing in the source-follower stage) may be used to control an external pass device configured to deliver the load current to the regulator output. A first resistor may be configured to decouple a load capacitor coupled between the regulator output and reference ground, when the load current is below a specified value, such as when the load current initially begins to rise (from a zero value, for example). A second resistor may be configured to create a bias current in the internal pass device even when the external pass device is close to cut-off region (i.e. it is not providing a load current into the regulator output. In one set of embodiments, a third resistor may be configured to counter the effects of negative impedance at the control terminal of the external pass device caused by the current-gain of the external pass device.

Other aspects of the present invention will become apparent with reference to the drawings and detailed description of the drawings that follow.

BRIEF DESCRIPTION OF THE DRAWINGS

The foregoing, as well as other objects, features, and advantages of this invention may be more completely understood by reference to the following detailed description when read together with the accompanying drawings in which.

Figure 1:
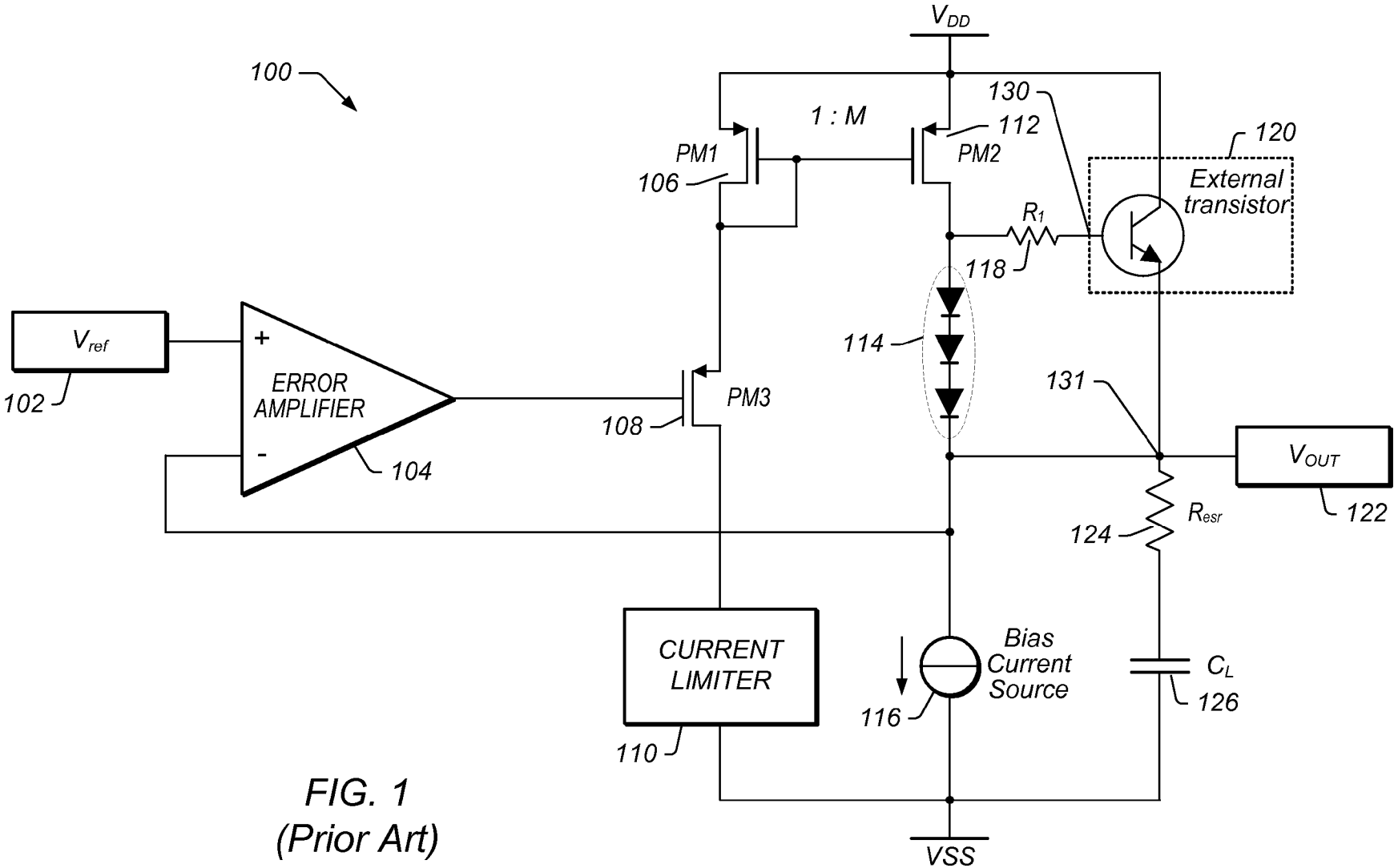
FIG. 1 (Prior Art)
FIG. 1 shows a logic circuit of one embodiment of a voltage regulator configured to provide current for high-voltage applications.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents, and alternatives falling within the spirit and scope of the present invention as defined by the appended claims. Note, the headings are for organizational purposes only and are not meant to be used to limit or interpret the description or claims. Furthermore, note that the word "may" is used throughout this application in a permissive sense (i.e., having the potential to, being able to), not a mandatory sense (i.e., must)." The term "include", and derivations thereof, mean "including, but not limited to". The term "connected" means "directly or indirectly connected", and the term "coupled" means "directly or indirectly connected".

DETAILED DESCRIPTION OF THE PREFERRED EMBODIMENTS

As used herein, the term "nominal value" is used to denote an expected, stable value. For example, the nominal value of a first supply voltage is used to denote the final, stable value reached by the first supply voltage. While the term "nominal" typically refers to a specified theoretical value from which an actual value may deviate ever so slightly, in order to simplify references to certain voltage values detailed herein, "nominal value" is used to refer to the final, expected stable value reached by a supply voltage. For example, as used herein, when a supply voltage has a nominal value of 3.3V, it means that the supply voltage is configured to settle and reside at a value of 3.3V. Of course, the actual value of the supply voltage may deviate ever so slightly from this value, and the term "nominal value" is meant to account for such deviations. Furthermore, as referenced herein, a "low load current" is expected to be in the range of a few μA (microamps), while a "high load current" is expected to be in the range of a few mA (milliamps).

Also, as used herein, a first signal "tracking" or "following" a second signal, or the value of the first signal "tracking" or "following" the value of the second signal denotes that the first signal changes as the second signal changes. In other words, if the second signal rises at a first rate, the first signal also rises at the first rate. Similarly, if the second voltage changes from 1V to 2V, the first signal also changes from 1V to 2V, and so on. Thus, a first signal tracking (or following) a second signal is meant to denote that the first signal is configured to have a value that is the same as the value of the second signal, and furthermore to change in the same manner as the second signal changes.

Various embodiments of circuits presented herein comprise a resistor or resistors. Those skilled in the art will appreciate that resistors in integrated circuit may be obtained in a variety of different ways, and that the resistors disclosed herein are meant to represent circuit elements whose electrical characteristics would match the electrical characteristics of resistors as configured in the disclosed embodiments. In other words, there may be embodiments where one or more transistor devices are configured to behave in a manner commensurate with the behavior of a resistor or resistors, and the resistors disclosed herein are meant to embody all components and/or circuit elements that may be configured as resistors. Similarly, any reference to "diodes" is meant to encompass all components and/or circuit elements that may be configured as diodes. For example, a "diode-connected transistor" may be used interchangeably with a "diode".

References are made herein to "channels" of transistors. While the structure of a (Metal-Oxide Semiconductor Field Effect Transistors) MOSFET comprises an identifiable channel that is well known to those skilled in the art, bipolar devices (also referred to as bipolar junction devices or bipolar junction transistors—BJT) may oftentimes be swapped with MOSFET devices in certain circuit configurations to obtain similar or identical operating characteristics in those circuits. While the structure of a bipolar device might not comprise an identifiable "channel" exactly like a MOSFET (or FET) device, for the sake of simplicity, a conductive or operational path established between the collector and emitter of a bipolar device (or BJT) is also referenced herein as the "channel" of that device. In other words, when referencing the "channel" of a given transistor, the word "channel" may equally refer to the operational (or conductive) path established between the drain and the source of the transistor device if the device is a MOSFET (FET), or between the collector and the emitter of the transistor device if the device is a bipolar device (e.g. BJT).

As also used herein, a "ratio" of a current mirror device refers to a ratio between the current conducted by the input branch of the current mirror and the current conducted by the output, or mirror branch of the current mirror. Thus, a current mirror having a "very high" ratio may indicate that the ratio of the input current vs. the mirrored current may be in the range of 1:1000. Furthermore, the "size" of a transistor or transistor device may refer to the channel width to channel length ratio (W/L) of the transistor device. Those skilled in the art will also appreciate that the value of an equivalent mirror current, that is, the mirror current for a current mirror having a ratio of 1, may typically be within 1% of the value of the mirrored current, and that various techniques may be employed to minimize or eliminate mismatch errors between the transistor devices comprised in the current mirror. Such mismatch errors may be present due to fabrication process variations, for example, and may be remedied using well known methods in the art, e.g. dynamic element matching (DEM).

FIG. 1 is a schematic diagram of one embodiment of a voltage regulator circuit 100 configured to provide load current for high-voltage applications, according to prior art. In the embodiment shown, an input supply voltage $V_{DD}$ is provided to operational amplifier 104. The voltage regulator circuit provides an output voltage from the terminal of transistor 120 coupled to node 131, which would typically be the emitter of an external NPN transistor, in this case a bipolar junction device, or transistor (BJT), also powered by $V_{DD}$. The current through transistor 120 is controlled via a feedback path from $V_{OUT}$ 122 to the inverting input of amplifier 104. Amplifier is an error amplifier, used in the circuit to indicate an error between a reference voltage $V_{ref}$ 102, which is provided to the non-inverting terminal of amplifier 104, and the voltage at the output 122. Operational amplifier 104 is configured to provide an output signal that is proportional to the difference between the reference voltage $V_{ref}$ and the output voltage $V_{OUT}$. External transistor 120 may be used to handle larger currents, to reduce the size requirements on internal pass device 112. In other words, by configuring external pass device 120, as shown, internal pass transistor 112 may be relatively small. Regulator 100 may be configured on-chip, as part of an integrated circuit (IC), with nodes 130 and 131 corresponding to pins configured to couple to external components. More specifically, node 130 may be configured to couple to an external transistor 120 to provide the load current for high-voltage applications, and node 131 may be configured to provide the regulated output voltage $V_{OUT}$ 122. The load to be powered by regulator 100 may thus be coupled to the output node 131.

In order to protect voltage regulator 100 while providing the necessary current to the load, the output of amplifier 104 may be used to control PMOS device 108 configured in a current branch conducting a current having a limited magnitude as determined by current limiter 110. This current branch may be configured as a source-follower stage as shown in FIG. 1. A current mirror comprising PMOS devices 106 and 112 is configured to mirror a multiple of the current flowing in PMOS device 106 to PMOS device 112 (i.e., to the drain of PMOS device 112). A bias current source 116 is provided to control the current flowing into output node 131, and diode devices 114 (which may be diode-connected transistors) are provided to clamp the voltage at output node 131, as protective measures. The ratio of the current mirror comprising PMOS devices 106 and 112 may be 1:M as indicated in FIG. 1, to obtain a mirror current at the drain of PMOS device 112, with the mirror current having a magnitude that is M times the magnitude of the current flowing through PMOS transistor 106. Capacitor $C_L$ 126 is an output capacitor, with resistor 124 indicating the equivalent series resistance of capacitor 126. Finally, the impedance from the emitter to the base of external transistor 120 appears as a negative impedance at the base of the external transistor 120, caused by the β (current-gain) of external transistor 120. A resistor R1 118 may be used to counter the effects of this negative impedance, with the value of resistor 118 determined by the β (current-gain) of external transistor 120.

One disadvantage of regulator 100 is that it may become unstable when the load current flowing into node 131 varies from zero to a maximum possible load current. During such a fast current increase, the poles and zeros of regulator 100 may vary not only based on the quickly varying load current, but also based on the region of operation of external transistor 120. One way to compensate for this may be the use of a large internal pass transistor 112 and elimination of external pass transistor 120, (i.e. making transistor 112 relatively large), and/or placing a large current load at output 122 (output node 131) of voltage regulator 100 to help stabilize voltage regulator 100. However, the use of these techniques may not always be possible. For example, use of a large current load may not provide a good solution as it may violate the current specification of the IC (on which voltage regulator 100 may be configured), which may be on the order of few tens of μA's (micro-Amperes) in deep sleep mode. In addition, configuring internal pass transistor 112 to be large enough to obviate the need for external transistor 120 may also not be an option, since high-voltage transistors don't have the same drive strength as low-voltage transistors, causing the die area required for a sufficiently large pass transistor 112 to be extremely large on a chip where die size may be limited.

Figure 2:
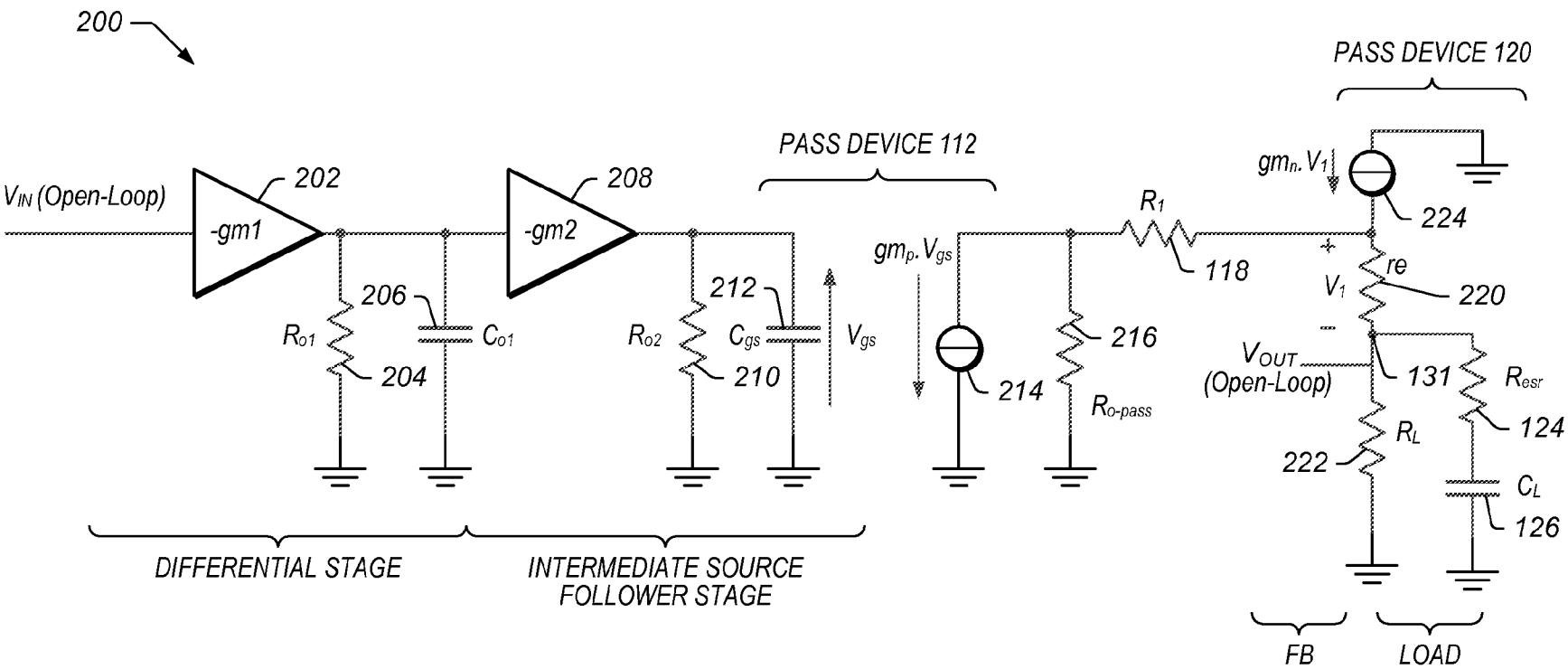
FIG. 2 shows a simplified small-signal diagram of the voltage regulator of FIG. 1.

Referring again to voltage regulator 100, as transistor 120 begins to turn on, its region of operation changes from being close to cutoff to entering the linear (active) region, thereby creating left-half-plane (LHP) poles (considering the system response of regulator 100), hence making the system unstable. FIG. 2 shows a small-signal circuit model 200 for the system that includes voltage regulator 100 shown in FIG. 1. The small signal circuit includes a representation of the transconductance 202 and equivalent output resistance 204 and output capacitance 206 of the differential stage (comprising amplifier 104), as well as a representation of the transconductance 208 and equivalent output resistance 210 of the intermediate source-follower stage (comprising PMOS devices 106 and 108). Transistor device 112 (labeled "PASS DEVICE 112" in FIG. 2) is represented by its gate-source capacitance 212, and equivalent current source 214 (a product of $gm_p$ and the gate source voltage $V_{gs}$ of transistor 112). The resistance seen at the drain of transistor 112 is represented by resistor 216. Finally, external transistor device 120 (labeled "PASS DEVICE 120" in FIG. 2) is represented by equivalent current source 224 and the equivalent resistance 220 seen at the emitter of transistor device 120, with the magnitude of the current provided by current source 224 being the product of $gm_n$ and voltage $V_1$, which corresponds to the voltage across equivalent resistance 220. A load coupled to node 131 ($V_{OUT}$ 122) is represented by load resistor 222.

In the small-signal AC analysis of the small-signal circuit 200 of FIG. 2, the output capacitor $C_L$ (126) and the output impedance (using the corresponding output transconductance value $gm_n$) of external transistor device 120 may determine the dominant pole of the system, given by P1 in the first equation below. The other two poles and the zero of the system are given in the subsequent equations shown below. From the small-signal model, the pole due to external transistor 120 may be given by:

$$P_1 = \frac{gm_n}{2\pi C_L}.$$

The pole due to pass transistor 112 may be given by:

$$P_2 = \frac{1}{2\pi R_{o\text{-}pass} \cdot C_L}.$$

The pole due to the output of error amplifier 104 may be given by:

$$P_3 = \frac{1}{2\pi R_{o2} \cdot C_{gs}}.$$

The zero created by the equivalent series resistance (ESR) of output capacitor 126 may be given by:

$$Z_1 = \frac{1}{2\pi R_{ESR} \cdot C_L}.$$

The poles at the output of error amplifier 104 and pass transistor 112 may create an unstable system with a total of three poles ($P_1$ through $P_3$ as expressed in the equations above), each of which may cause a 90° deterioration in phase margin, which may result in the system becoming unstable. All three poles described above may be very low frequency poles as a result of the high voltage devices having very high impedance, and regulator 100 utilizing very low current. The overall quiescent current of regulator 100 in this application may be about 7.5 μA.

Figure 3:
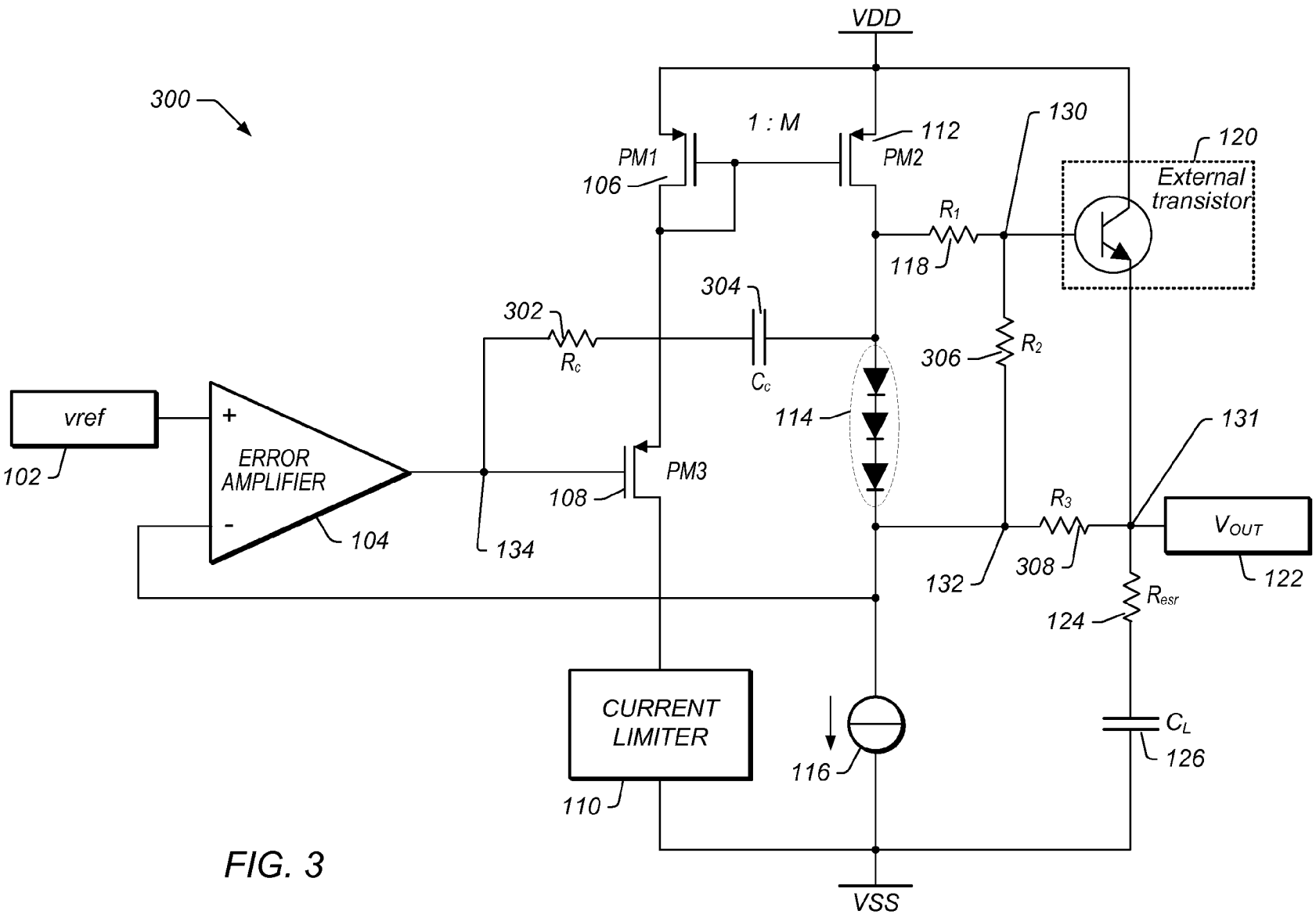
FIG. 3 shows one embodiment of a stable voltage regulator according to one set of embodiments.
Figure 4:
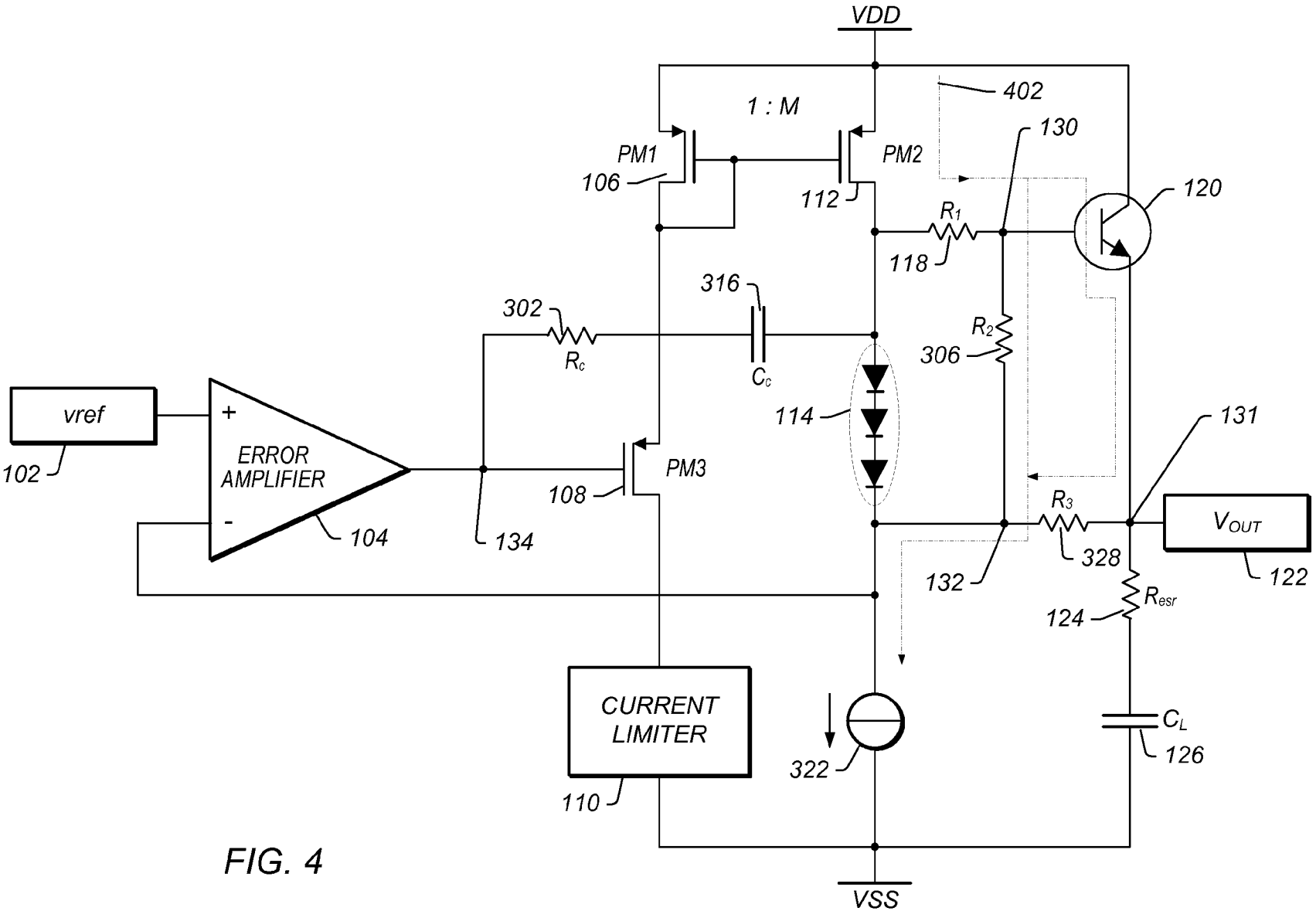
FIG. 4 illustrates current flow in the stable voltage regulator of FIG. 3 for low or no load current, according to one set of embodiments.
Figure 5:
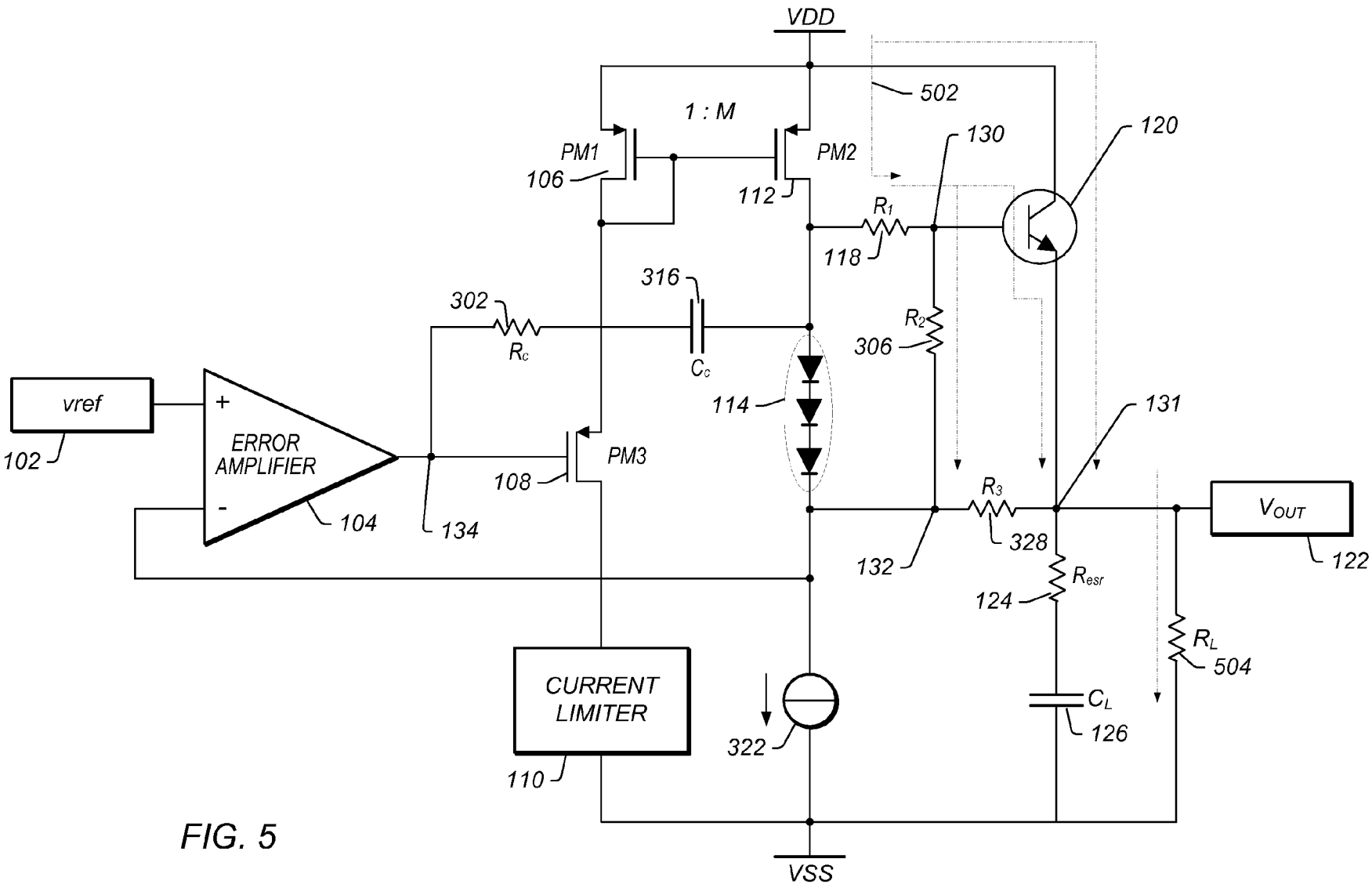
FIG. 5 illustrates current flow in the stable voltage regulator of FIG. 3 when load current is present, according to one set of embodiments.

FIG. 3 shows one embodiment of a frequency compensation technique that may be implemented in regulator circuit 100. In one set of embodiments, frequency compensation, and thus stabilization of regulator 100, may be performed by adding four components, resistors 306, 308 and 302, and capacitor 304 as shown. Resistor $R_3$ may be used to decouple external capacitor 126 from node 132, which is coupled to the inverting input of error amplifier 104, during a no-$I_{Load}$ condition when only a small bias current is available. When the load-current ($I_{Load}$) is low, there may be two paths for the current to flow, as shown FIG. 4 (paths 402). The external transistor device 120 may have very little current flowing through it, as most of the current may flow through resistor $R_2$ 306 as shown. The pole due to the external transistor device 120 may therefore be decoupled during this period, with most of the current flowing through resistor $R_2$ 306. Since resistor $R_3$ 328 may be configured to decouple external capacitor $C_L$ 126 (as shown), the pole that would be created due to external capacitor $C_L$ may thereby be isolated. Configuring resistor 328 as shown may therefore also create an additional LHP zero, increasing the stability of regulator 100. As shown in FIG. 5, with an increasing load current $I_{Load}$, (for example, as a result of the load coupled to node 131 decreasing), most of the current may be flowing through external transistor 120 (current paths 502), with very little current flowing through resistor $R_2$ 306. The increasing load current $I_{Load}$ (decreasing load resistance 504) may result in most of the current flowing through external pass device 120, which in turn may result in resistor $R_3$ 328 becoming a part of the feedback network.

Figure 6:
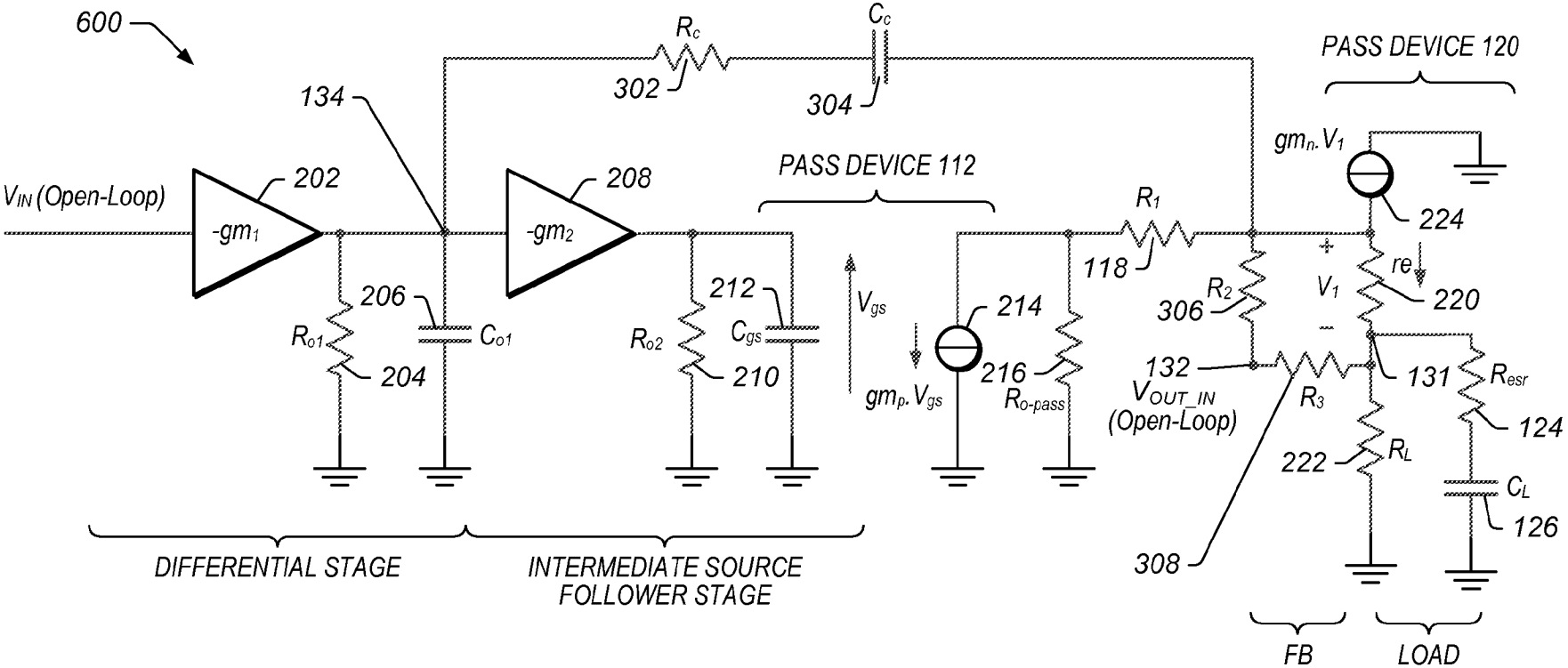
FIG. 6 shows a simplified small-signal diagram of the stable voltage regulator of FIG. 3.

A simplified small-signal model of the frequency compensated voltage regulator 300 of FIG. 3 is shown in FIG. 6. Since resistor $R_3$ 308 may be configured to decouple external capacitor $C_L$ 126, the pole that would be created due to capacitor 126 may be isolated under a no-load-current (no $I_{Load}$) condition. An additional LHP zero may thereby also be created, aiding in providing better stability to the voltage regulator 300 under no $I_{Load}$ conditions. Thus, the pole created by external pass device 120 may be given by:

$$P_1 = \frac{gm_n}{2\pi C_L},$$

and the zero created by decoupling resistor 328 under a no $I_{Load}$ condition (or low $I_{Load}$ condition; more generally when external pass device 120 is not operating in the active region), may be given by:

$$Z_2 = \frac{1}{2\pi R_3 \cdot C_L}.$$

As can be seen from the above expressions, as the load current increases, the transconductance ($gm_n$) of external transistor device 120 may increase, capacitor $C_L$ 126 may no longer be decoupled, and the pole due to external pass transistor 120 may be pushed to a higher frequency as the transconductance is proportional to current ($gm_n \propto I$). In addition, the zero $Z_2$ may move to higher frequencies as the load current $I_{Load}$ increases.

As the load current $I_{Load}$ increases, pole $P_2$ may increase at a faster rate, ($R_{o\text{-}pass}$ 216 decreases linearly with increasing current, $1/\lambda I$, where $\lambda$ is the channel-length modulation parameter of MOS devices), than the rate at which the gain of the system ($gm_p$) decreases. Therefore, a desired (optimal) behavior of voltage regulator 300 may be obtained by choosing the capacitor with the right ESR. The type and value of capacitor 126 may therefore determine the location of poles $P_1$ and $P_2$, and zero $Z_1$. Pole 2 may be expressed as:

$$P_2 = \frac{1}{2\pi R_{o\text{-}pass} \cdot C_L},$$

and zero 1 may be expressed as:

$$Z_1 = \frac{1}{2\pi R_{ESR} \cdot C_L}.$$

A compensation capacitance $C_C$ 304 shown in FIG. 6 may be bi-directional. In other words, both feedback and feed-forward currents may flow through capacitor 304 at the same time. The feedback current may be the Miller-effect current flowing from the output to the input, between two nodes which are opposite in phase. The feed-forward current from amplifier 104 may flow through capacitor Cc 304, which may result in a small output signal that is in phase with the input. This is the current that may cause the zero. It may be a right-hand-plane (RHP) zero because it provides an output signal, which may be opposite in phase compared with the amplified output signal. To cancel the effect of the RHP zero, a resistor $R_C$ 302 may be used, whose value may be greater than 1/gm of MOS pass device 112.

The regulator output voltage $V_{OUT}$ with the addition of resistors 118, 306, and 328 may then be expressed by:

$$V_{out} = \frac{V_{out_in} \cdot R_2}{R_2 + R_3},$$

where $R_2$ may be much larger than $R_3$ in order to avoid a large offset in the output voltage.

Referring again to FIG. 3, the operation of voltage regulator 300 may be summarized as follows. A first resistor $R_3$ 308 may be configured to decouple load capacitor $C_L$ 126 from node 132 when there is no load current, or more generally, when the load current $I_{Load}$ is small/low, or is below a specified value, as external pass transistor 120 starts to turn on and enter the active (linear) operating region. A second resistor, resistor $R_2$ 306 may be configured to couple the output at node 130 to the output at node 132, to create a bias current through internal pass transistor device 112 even when external transistor 120 is close to the cut-off region. A third resistor, resistor $R_1$ may be configured between the drain terminal of internal pass transistor 112 and output node 130 to counter the effects of negative impedance at the base of external transistor 120 caused by the $\beta$ (Current-gain) of external transistor 120. A compensation capacitance 316 to conduct a feedback current (resulting from the Miller-Effect) may be configured between the inverting input and the output of error amplifier 104. In order to cancel the effect of an output signal opposite in phase to the amplified output signal (resulting from a feed-forward current also flowing in capacitor 316), a fourth resistor 302—having a value greater than the transimpedance of pass transistor 112—may be configured between the output of error amplifier 104 and capacitor 316.

It should be noted again that voltage regulator 300 may also be operated without external transistor 120, depending on the expected magnitude of the load current to be provided into node 131. Depending on its size, internal pass transistor 112 may be capable of delivering a certain amount of load current, as long as a path exists through pass transistor 112 into node 131 to a load coupled to node 131 (such as load 504 shown in FIG. 5, for example). For example, the size of pass transistor 112 may be large enough for delivering a few hundred μA of current. In that case, without external transistor 120, current may flow through internal pass transistor 112, through resistors 118, 306, and 308, into node 131 and into a load coupled to node 131. While the necessary path for a current to flow from internal transistor 112 to node 131 may be established without resistor 118 and resistor 308, as long as node 131 is conductively coupled to the drain of transistor 112, an added advantage of various embodiments that include resistors 118, 306, and 308 is that they may equally be used without external transistor 120, while also providing the added benefits as disclosed herein when operated with external transistor 120.

Although the embodiments above have been described in considerable detail, other versions are possible. Numerous variations and modifications will become apparent to those skilled in the art once the above disclosure is fully appreciated. It is intended that the following claims be interpreted to embrace all such variations and modifications. Note the section headings used herein are for organizational purposes only and are not meant to limit the description provided herein or the claims attached hereto.

We claim:

1. A voltage regulator comprising:

a first output node configured to provide a regulated output voltage;

a second output node configured to couple to a control terminal of an external pass device that has one end of its channel coupled to the first output node to provide a load current for high-voltage applications;

an internal pass device having a first end of its channel coupled to a supply voltage and a second end of its channel coupled to the second output node to control the external pass device;

an error amplifier having a first input configured to receive a reference signal and a second input coupled in a feedback loop with the first output node, and further having an output configured to control a current branch that establishes current flowing in the internal pass device, to control the regulated output voltage; and a first resistor having a first end coupled to the first output node and a second end coupled to the second output node to create a bias current in the internal pass device when the external pass device is not providing the load current.

2. The voltage regulator of claim 1, further comprising:

a load capacitor coupled between the first output node and reference ground; and a second resistor having one end coupled to the first output node and a second end coupled to the first end of the first resistor, to decouple the load capacitor from the feedback loop when the load current has a magnitude lower than a specified value.

3. The voltage regulator of claim 1, further comprising a second resistor having a first end coupled to the second end of the channel of the internal pass device, and a second end coupled to the second output node to counter effects of negative impedance caused by a current-gain of the external pass device at the control terminal of the external pass device.

4. The voltage regulator of claim 1, further comprising a compensation capacitor having a first end coupled to the output of the error amplifier and a second end coupled to the second output node, to conduct a feedback current resulting from the Miller-Effect.

5. The voltage regulator of claim 4, further comprising a second resistor having a first end coupled to the output of the error amplifier and a second end coupled to the first end of the compensation capacitor, to cancel an effect of an output signal opposite in phase to an output signal of the error amplifier, resulting from a feed-forward current flowing in the compensation capacitor.

6. The voltage regulator of claim 1, further comprising one or more devices coupled in series between the first output node and the second output node to ensure that a voltage at the second output node does not reach a same value as the supply voltage, when the external pass device is not coupled to the second output node.

7. The voltage regulator of claim 6, wherein the one or more devices comprise one or more of:

diodes; or diode-connected transistors.

8. A voltage regulator comprising:

a first output node configured to provide a regulated output voltage;

a second output node configured to couple to a control terminal of an external transistor device that has one end of its channel coupled to the first output node to provide a load current for high-voltage applications;

an internal transistor device having a first end of its channel coupled to a supply voltage and a second end of its channel coupled to the second output node to control the external transistor device;

a current branch configured to establish a current flowing in the internal transistor device;

an error amplifier having a first input configured to receive a reference signal and a second input coupled in a feedback loop with the first output node, and further having an output configured to control the current branch to control the regulated output voltage;

a load capacitor coupled between the first output node and reference ground; and a first resistor configured to decouple the load capacitor from the second input of the error amplifier when the load current has a magnitude lower than a specified value.

9. The voltage regulator of claim 8, further comprising a second resistor having a first end coupled to a first end of the first resistor, and a second end coupled to the second output node to create a bias current in the internal transistor device when the external pass device is not providing the load current.

10. The voltage regulator of claim 9, further comprising a compensation capacitor having a first end coupled to the output of the error amplifier and a second end coupled to the second end of the channel of the internal transistor device, to conduct a feedback current resulting from the Miller-Effect.

11. The voltage regulator of claim 10, further comprising a third resistor having a first end coupled to the output of the error amplifier and a second end coupled to the first end of the compensation capacitor, to cancel an effect of an output signal opposite in phase to an output signal of the error amplifier, resulting from a feed-forward current flowing in the compensation capacitor.

12. The voltage regulator of claim 11, further comprising a fourth resistor having a first end coupled to the second end of the channel of the internal transistor device, and a second end coupled to the second output node to counter effects of negative impedance caused by a current-gain of the external transistor device at the control terminal of the external transistor device.

13. The voltage regulator of claim 12, further comprising one or more diode devices coupled in series between the second end of the channel of the internal transistor device and the first end of the first resistor, to clamp the regulated output voltage.

14. The voltage regulator of claim 8, wherein the current branch is a source follower stage comprising a current limiter configured to limit current flowing in the source follower stage.

15. The voltage regulator of claim 14, wherein the source follower stage comprises a transistor device in a current mirror configuration with the internal transistor device, to mirror a multiple of the current flowing in the source-follower stage to the second node of the channel of the internal transistor device.

16. A method for regulating an output voltage at an output node configured in a feedback loop, the method comprising:

generating a first control signal based on a reference voltage and the output voltage;

using the first control signal to control a first current flowing in a first current branch;

mirroring a multiple of the first current to a first pass device to obtain a second current flowing in the first pass device to control the output voltage;

using a voltage developed by the second current to control a second pass device configured to provide a load current into the output node; and decoupling a capacitor coupled between the output node and reference ground from the feedback loop when the load current has a magnitude lower than a specified value.

17. The method of claim 16, further comprising creating a bias current in the first pass device when the second pass device is not providing the load current.

18. The method of claim 16, further comprising eliminating effects of negative impedance caused by a current-gain of the second pass device at a control terminal of the second pass device.

19. A voltage regulator comprising:

a first output node configured to provide a regulated output voltage;

a second output node configured to couple to a control terminal of an external pass transistor that has its channel coupled between a supply voltage and the first output node, to provide a load current into the first output node;

a first resistor coupled between the second output node and a first internal node;

a second resistor coupled between the second output node and a second internal node;

a third resistor coupled between the second internal node and the first output node;

a load capacitor coupled between the first output node and reference ground;

an internal pass transistor having a channel coupled between the supply voltage and the first internal node;

a source-follower stage coupled between the supply voltage and reference ground, and configured to mirror a multiple of a current flowing in the source-follower stage to the internal pass transistor; and an error amplifier having a first input configured to receive a reference signal and a second input coupled to the second internal node, and further having an output configured to control the source-follower stage to control the regulated output voltage.

20. The voltage regulator of claim 19, further comprising a compensation capacitor and a fourth resistor coupled in series between the output of the error amplifier and the first internal node.

21. The voltage regulator of claim 20, wherein a value of the fourth resistor is greater than a transconductance of the internal pass device.

22. The voltage regulator of claim 19, further comprising one or more diode devices coupled between the first internal node and the second internal node.

23. A system comprising:

a voltage regulator comprising:

a first output node configured to provide a regulated output voltage;

a second output node;

a first resistor coupled between the second output node and a first internal node;

a second resistor coupled between the second output node and a second internal node;

a third resistor coupled between the second internal node and the first output node;

a load capacitor coupled between the first output node and reference ground;

an internal pass transistor having a channel coupled between the supply voltage and the first internal node;

a source-follower stage coupled between the supply voltage and reference ground, and configured to mirror a multiple of a current flowing in the source-follower stage to the internal pass transistor; and an error amplifier having a first input configured to receive a reference signal and a second input coupled to the second internal node, and further having an output configured to control the source-follower stage to control the regulated output voltage;

an external pass transistor having a control terminal coupled to the second output node of the voltage regulator, and further having a its channel coupled between a supply voltage and the first output node of the voltage regulator, to provide a load current into the first output node of the voltage regulator; and a load coupled to the first output node to conduct the load current.

24. The system of claim 23, wherein the voltage regulator is configured on an integrated circuit.

25. The system of claim 23, wherein the internal pass device is a MOSFET and the external pass transistor is a BJT.

26. A voltage regulator comprising:

a first node configured to provide a regulated output voltage;

a second node;

an internal pass device having a first end of its channel coupled to a supply voltage and a second end of its channel coupled to the second node;

a current branch coupled to the internal pass device;

an error amplifier having a first input configured to receive a reference signal and a second input coupled in a feedback loop with the first node, and further having an output configured to control the current branch to establish current flowing in the internal pass device, to control the regulated output voltage; and a first resistor having a first end coupled to the first node and a second end coupled to the second node to establish a bias current in the internal pass device to provide a load current into the first node.

27. The voltage regulator of claim 26, further comprising:

a load capacitor coupled between the first node and reference ground; and a second resistor having one end coupled to the first node and a second end coupled to the first end of the first resistor, to decouple the load capacitor from the feedback loop when the load current has a magnitude lower than a specified value.

28. The voltage regulator of claim 26 further comprising a compensation capacitor having a first end coupled to the output of the error amplifier and a second end coupled to the second node, to conduct a feedback current resulting from the Miller-Effect.

29. The voltage regulator of claim 28, further comprising a second resistor having a first end coupled to the output of the error amplifier and a second end coupled to the first end of the compensation capacitor, to cancel an effect of an output signal opposite in phase to an output signal of the error amplifier, resulting from a feed-forward current flowing in the compensation capacitor.

* * * * *